United States Patent [19]

Pürrer

[11] 4,454,785

[45] Jun. 19, 1984

[54] CONTROL ELEMENT FOR AGRICULTURAL MACHINE

[75] Inventor: Josef Pürrer, Gottmadingen, Fed. Rep. of Germany

[73] Assignee: Klöckner-Humboldt-Deutz AG Zweigniederlassung Fahr, Gottmadingen, Fed. Rep. of Germany

[21] Appl. No.: 312,130

[22] Filed: Oct. 16, 1981

[30] Foreign Application Priority Data

Oct. 20, 1980 [DE] Fed. Rep. of Germany ..... 3039584

[51] Int. Cl.[3] ..... G05G 1/04; H01H 3/00

[52] U.S. Cl. ..... 74/523; 74/503; 74/471 R; 200/157; 200/153 L; 200/61.85

[58] Field of Search ..... 74/503, 504, 471 R, 74/523; 200/157, 153 L, 61.85, 61.27, 61.54

[56] References Cited

U.S. PATENT DOCUMENTS 3,354,981 11/1967 Swanson et al. ..... 180/77

FOREIGN PATENT DOCUMENTS 951763 10/1956 Fed. Rep. of Germany .
1163428 2/1964 Fed. Rep. of Germany .
2739593 3/1978 Fed. Rep. of Germany .
1343078 1/1974 United Kingdom .

OTHER PUBLICATIONS

Article Entitled "Olhydraulische Antriebe und Steuerungen an Selbstfahrended Mähdreschern"-M. Kahrs, Nov. 1972.

*Primary Examiner*—Leslie A. Braun
*Assistant Examiner*—Anthony Wm. Raskob, Jr.
*Attorney, Agent, or Firm*—Karl F. Ross; Herbert Dubno

[57] ABSTRACT

A control element for an agricultural machine comprises a standard lever pivotal about a lever axis through angularly offset positions associated with respective operational levels of the machine. This lever carries a handle remote from the lever axis and centered on a handle axis different from the lever axis and a grip carried on the handle and rotatable thereon about the handle axis between at least one grip end position and an angularly offset grip central position. A grip switch is actuatable by the grip only in the grip end position. A thumb-operable pin is axially displaceable in the handle between an outer pin position and at least one inner pin position. A pin switch is actuatable by the pin only in the inner pin position, and biasing means urges the pin into the outer pin position.

6 Claims, 5 Drawing Figures

CONTROL ELEMENT FOR AGRICULTURAL MACHINE

FIELD OF THE INVENTION

The present invention relates to a control element for an agricultural machine. More particularly this invention concerns a control element of the type used on a machine such as a harvester, combine, or thresher.

BACKGROUND OF THE INVENTION

An automotive agricultural machine, such as a combine, field chopper, or the like, frequently has a speed-control element—the so-called throttle—which is constituted as a lever pivotal about a horizontal axis normally at floor level and provided on its free upper end with a horizontal handle extending parallel to the lever pivot axis. Normally this lever is provided immediately ahead and to the right of the operator seat and next to the steering wheel, so the machine operator can easily reach it with his or her right hand to set or reset the machine ground speed. The lever holds in any set position, and normally is pushed forward to increase ground speed and pulled back to decrease it or stop so that there is some logical relationship between the motion of the control element and the response of the controlled function.

In addition to the operator's duties of steering the machine and establishing ground speed, he or she must be ready to raise or lower the intake to compensate for changes in terrain. It is furthermore necessary to occasionally reverse the intake device as well as the cutter drum if something, such as a piece of wood or wild animal, that could itself be hurt or that could damage the machine gets caught in the machine.

Obviously the controls for these various functions must be as convenient as possible to the operator. Even in the best systems, however, there is an often unacceptably long reaction time before they can be operated, and it is even fairly common that the wrong control is operated in an emergency.

OBJECTS OF THE INVENTION

It is therefore an object of the present invention to provide an improved agricultural-machine control element.

Another object is the provision of such an agricultural-machine control element which overcomes the above-given disadvantages.

A further object is to provide a control element which operates in the above-described classic way to adjust speed, but which also serves other control functions.

SUMMARY OF THE INVENTION

These objects are attained according to the instant invention in a control element which comprises a standard lever pivotal about a lever axis through angularly offset positions associated with respective operational levels or functions of the machine. This lever carries a handle remote from the lever axis and centered on a handle axis different from the lever axis and an axially nondisplaceable grip carried on the handle and rotatable thereon about the handle axis between at least one grip end position and an angularly offset grip central position. Means including a grip switch is actuatable by the grip only in the grip end position. A thumb-operable pin is axially displaceable in the handle between an outer pin position and at least one inner pin position. Means including a pin switch is actuatable by the pin only in the inner pin position, and biasing means urges the pin into the outer pin position.

Thus with the system according to the invention the element that normally serves for speed control can also be set up to control at least two other functions of the machine, and can easily be arranged to cover five or more. In a particularly advantageous setup the raising and lowering of the machine intake is controlled by rotation of the handle grip about the handle axis, that is the grip is turned forward to lower the intake and backward to raise it. The thumb pin serves to reverse the intake and, if necessary also the cutter or thresher drum.

This effect is best achieved when the grip is formed with at least one radially outwardly open and angularly extending groove having a region of relatively shallow depth aligned radially with the grip switch in the grip end position and a region of relatively deep depth aligned radially with the grip switch in the grip central position, or vice versa. In this case the grip switch has a switch member spring biased into engagement with the groove. More particularly, the grip has two such end positions to either angular side of the grip central position, each such grip end position being associated with a respective such grip switch. The grip thus is formed with two such grooves each having one such shallow region radially aligned with the respective grip switch in the respective end position, or one deep region, depending on whether the switch is actuated with its switch member in the in or out position. In this manner it is relatively easy for the grip to control two separate functions, one on rotation from the central position in one direction and one on rotation from the central position in the opposite direction. Control of more different functions is possible by providing more positions in which respective switches are actuated in the same manner.

According to this invention the lever has an outer end provided with a cylindrical tube centered on the handle axis. The pin is axially displaceable inside the tube and the grip is angularly displaceable on the tube.

In addition means is provided for retaining the grip releasably in the central position. To this end the grip is formed with a radially outwardly open notch. The retaining means includes a spring-loaded member radially inwardly engageable in the notch. Such a retaining means is useful when the grip has two end positions flanking the central position and each associated with a respective such grip switch for a different function, as it signals the operator when he or she is passing from the one function to the other.

In accordance with another feature of this invention the pin switch has a switch member spring biased into engagement with the pin. The pin is formed with a control surface aligned with the pin switch in the outer position and offset from the pin switch in the inner position. The switch member of the pin switch can be axially spring biased or the control surface can be formed by a radially outwardly open cutout and the switch member can be radially inwardly spring biased. It is possible according to this invention to provide two or more such pin switches which are sequentially actuated as the pin is pushed in. The one switch can reverse the intake of the machine, and the other the cutter or threshing drum, so that if the pin is pushed partially in the intake will eject what it holds, and if pushed all the way in the cutter also will reverse to eject what it is working on.

According to this invention the switch members of the various grip and pin switches are all arranged to move in a common plane, with the axes of their displacements all being parallel within the plane. Such an arrangement allows the control element to be made and serviced rather easily.

Instead of simple on-off or binary-action switches, it is of course within the scope of this invention to use steplessly variable controls, such as potentiometers, that are actuated by the grip and pin. Such controls allow fine adjustment of the respective functions. Furthermore it is possible to control three or more different functions with the grip and pin, so long as they are logically related in order not to confuse the operator.

DESCRIPTION OF THE DRAWING

The above and other features and advantages will become more readily apparent from the following, reference being made to the accompanying drawing in which.

SPECIFIC DESCRIPTION

Figure 1:
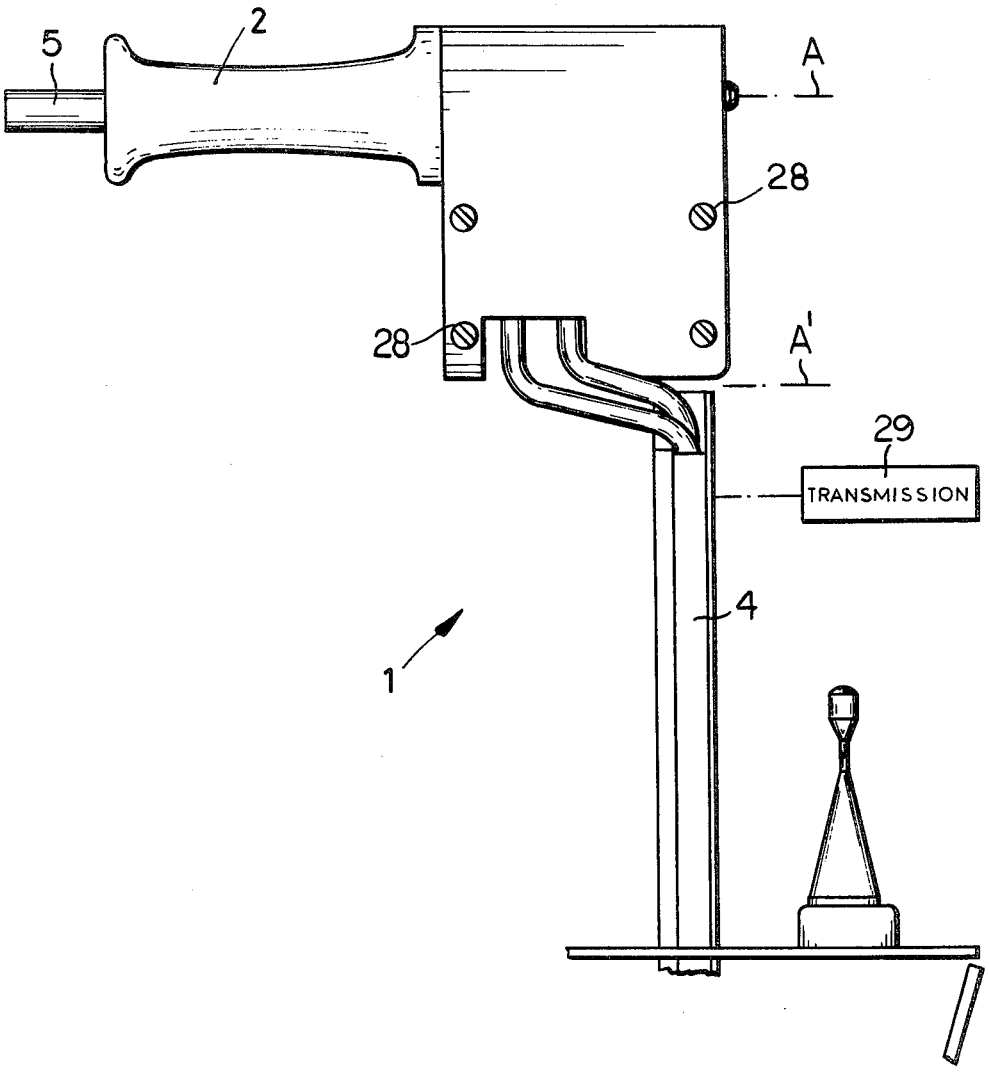
FIG. 1 is a side view of the control element according to this invention.

As seen in FIG. 1 a control element 1 according to the instant invention has a hand grip 2 centered on a horizonal axis A and extending horizontally toward the left, as seen by the operator employing the control element 1, from the upper end of a speed-control lever 4 pivotal about a horizontal axis A' which is parallel to but offset from the axis A. Normally the axis A' is well below the axis A, but here is shown somewhat closer for convenience of illustration. Pivoting about this axis A' varies the ground speed of the machine incorporating the element 1 by acting on the appropriate element of the machine transmission 29. The lever 4 holds in any set position, so the operator can set a given speed and take his or her hand off the grip 2 without the speed changing. For a logical relationship between the position of the control element and the level of the controlled function, here speed, the lever 4 is pushed forward to increase speed and pulled back to decrease it.

The upper end of the lever 4 is fixed to a tube 3 centered on the axis. The grip 2 is tubular and is secured axially in position on the tube 3 in one direction by a snap ring 30 and in the opposite direction by axial abutment against the upper end of the lever 4. The inside diameter of the tubular grip 2 is slightly more than the outside diameter of the tube 3 so this grip 2 can rotate freely on the tube 3 about the axis A.

Figure 2:
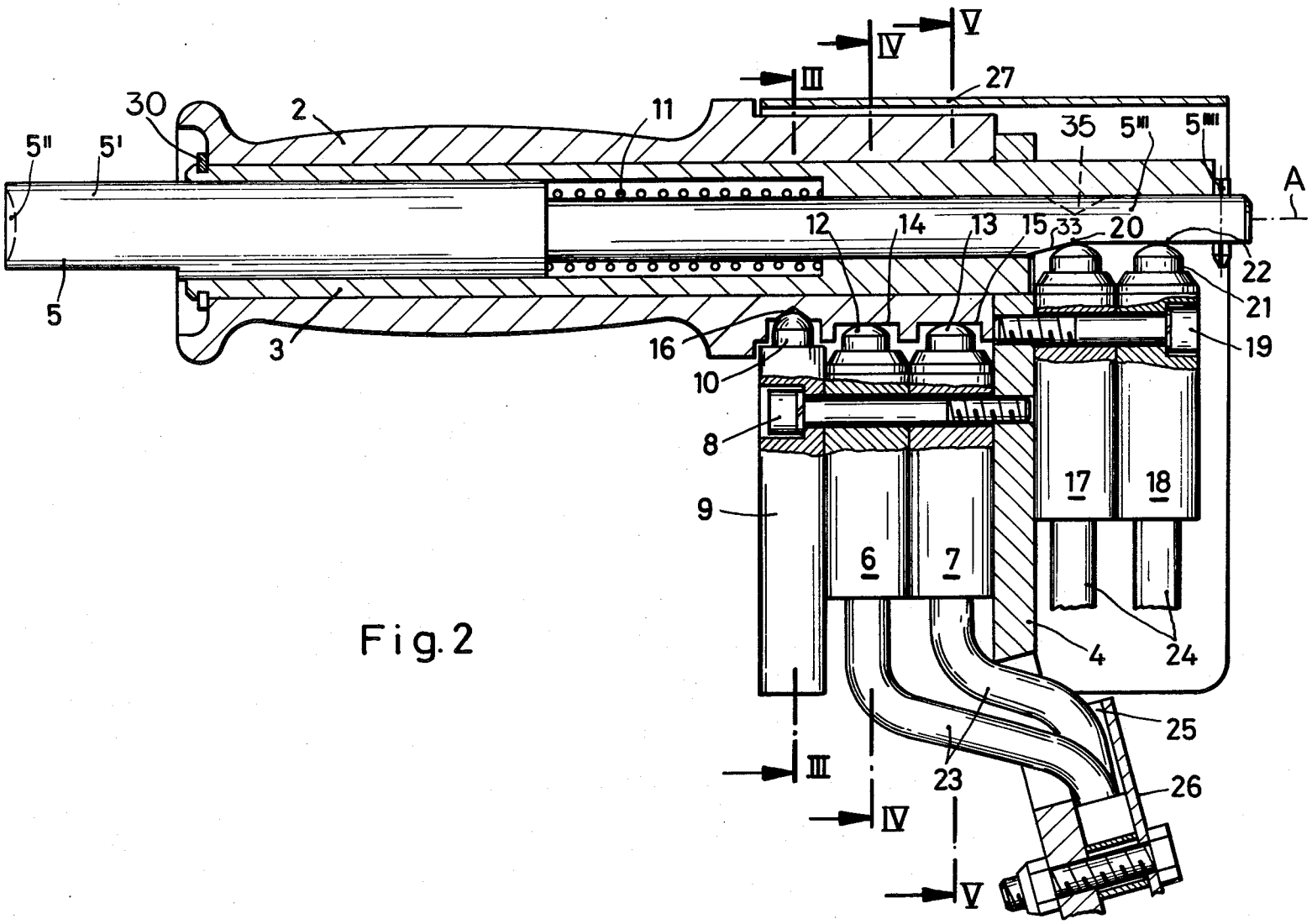
FIG. 2 is an axial section through the element of FIG. 1.
Figure 3:
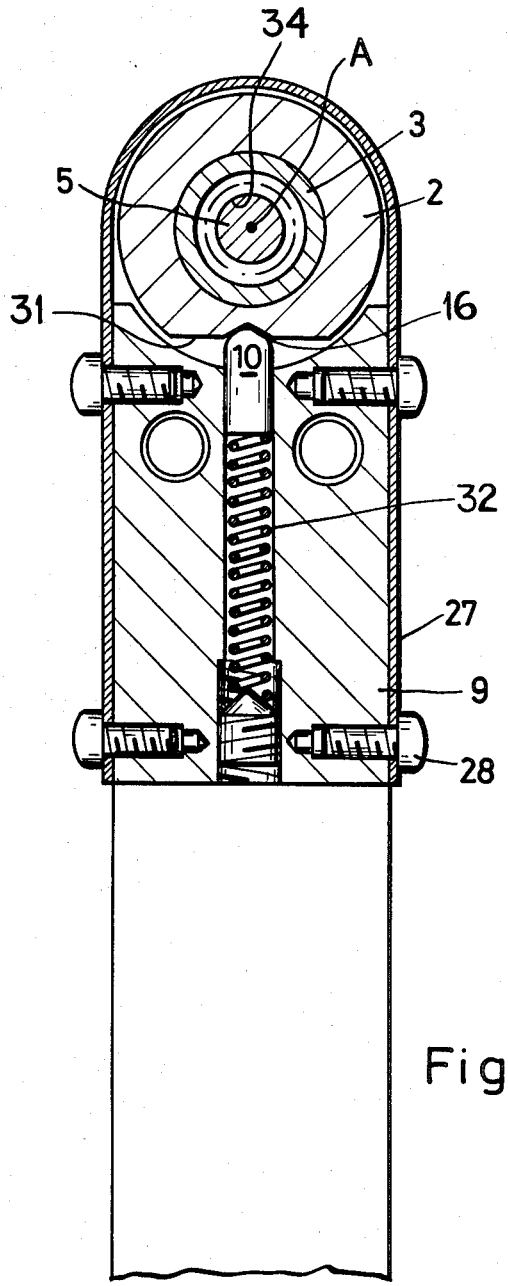
FIGS. 3, 4, and 5 are sections taken along respective lines III—III, IV—IV, and V—V of FIG. 2.

As better shown in FIGS. 2 and 3 the grip 2 is formed with a flat 31 in the center of which is formed a notch or recess 16 into which a retaining element 10 is urged by a compression spring 32 inside a passage in a block 9. This retaining element 10 therefore establishes for the grip 2 an angularly central position from which it can only be moved when twisted with sufficient force to push the element 10 back down against its spring 32.

Figure 4:
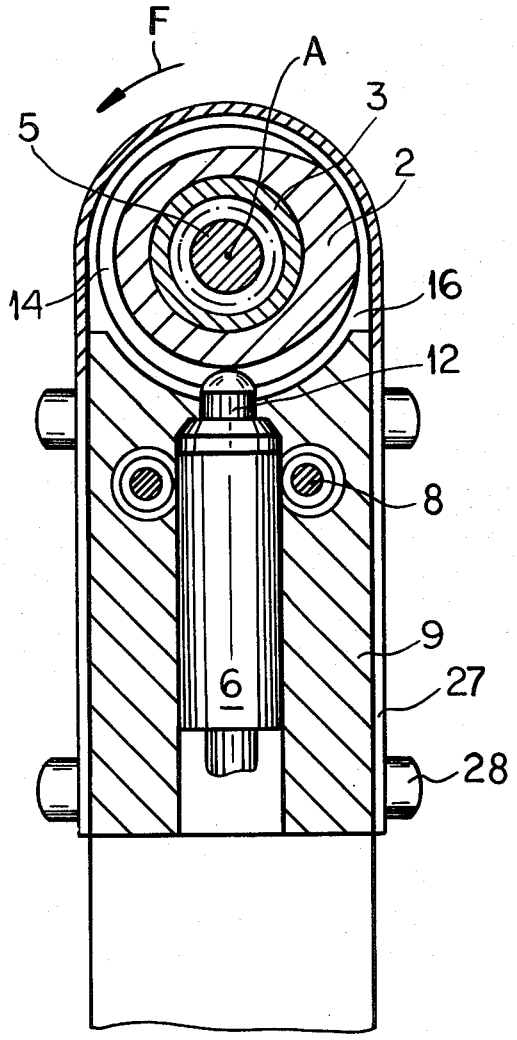
Figure 5:
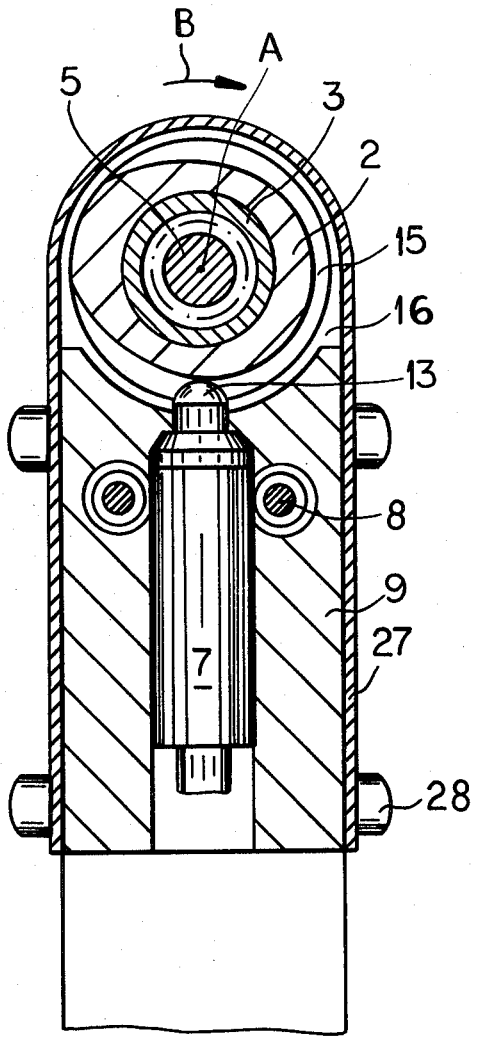

The grip 2 is also formed with a pair of radially outwardly open grooves 14 and 15 visible also in FIGS. 4 and 5 and receiving respective switch elements 12 and 13 of respective switches 6 and 7. These switches 6 and 7 respectively operate valves or like control members that lower and raise the intake device of the agricultural machine incorporating the control element 1. To this end the groove 14 becomes shallower ahead, in the forward rotation direction F of the grip 2 so that the switch member 12 will be depressed and the switch 6 will be actuated when the grip is turned in this direction and its spring-loaded switch member 12 is pushed in. Similarly the groove 15 becomes shallower in the backward direction B to close and actuate the respective control valve or the like when the grip is turned back to raise the intake of the agricultural machine. The grooves 14 and 15 could be oppositely inclined, of course, in which case the switches would open and close oppositely.

The switches 6 and 7 and the retainer 9 are secured by a pair of bolts 8 to the upper end of the lever 4 with their members 10, 12, and 13 all movable along respective coplanar and parallel axes. Thus removal of any of these elements is relatively easy. The wires 23 leading from the switches 6 and 7 pass along a channel 25 formed in the lever 4 and closed by a cover plate 26. Obviously these switches 6 and 7 could be replaced by pneumatic or hydraulic valves, or by stepless controls such as potentiometers.

To raise and lower the intake head of the machine incorporating the control element, therefore, the operator need merely rotate the grip 2. Rotating it forward will lower the head and rotating it back will raise it. The motions and their results are therefore logically related.

A pin 5 is axially displaceable within the tube 3. This pin 5 is urged axially out by a compression spring 11 surrounding its narrow-diameter rear portion in the tube 3 and has a rear end 5''' provided with a snap ring 5'''' which prevents it from moving further out of the tube 3 than the illustrated outer position. The projecting front end 5' of this pin 5 is formed with a recess 5'' shaped to receive the ball of the thumb of the right hand normally clasped around the grip 2. A longitudinal groove 34 in the pin or rod 5 is engaged by a projection 35 so that the pin 5 cannot rotate inside the tube 3 about the axis A.

The rear end 5''' is formed with a flat cutout 22 joined by an inclined ramp or guide surface 33 to the cylindrical outer surface of the pin 5. Two axially spaced switches 17 and 18 have respective switch members 20 and 21 spring biased radially inward into engagement with the pin 5. These switches 17 and 18 close to reverse the machine intake and the machine cutter or thresher drum, respectively when their switch members 20 and 21 are depressed from the illustrated positions. As the pin 5 is depressed axially inward, to the right in FIG. 2 the switch member 20 will first be pushed down as it rides from the surface 22 over the ramp 33 to the outer surface of the pin 5, reversing the machine intake, and when further depressed the switch 18 is similarly actuated to reverse the cutter or thresher drum.

The two switches 17 and 18 are together held by screws 19 like the screws 8 on the upper end of the lever 4. The wires 24 from these switches 17 and 18 similarly run down the channel 25, like the wires 23. The axes of motion of all of the switch members 12, 13, 20, and 21 are coplanar and parallel. A U-shaped cover plate 27 is secured by screws 28 on top of the assembly to protect the various parts, while making them readily accessible for servicing.

If the operator sees that something that should not be picked up has just entered the intake, he or she can depress the pin 5 and eject it from the intake head. If something has been pulled all the way into the machine, the chains, cutter, drum or the like can be reversed by further depression of this pin 5 to eject it also. As it is standard for an operator of such a machine to operate it with the left hand on the steering wheel and the right hand on the grip 2, this means that the reaction time for both raising and lowering the intake as well as for reversing it will be very low. What is more, the ergonomic design of the control element 1 according to this invention makes getting used to it extremely useful, as the motions necessary to control the various functions are different enough—pivoting of the lever 4 for speed control, twisting of the grip 2 for height adjustment, depression of the pin 5 for reversing—that they will not be confused with one another, and they are soon automatic for the operator. There is obviously no need for the operator to have to move his or her hands around to actuate various spaced-apart controls so the possibility of error is greatly reduced, as is operator fatigue.

It is within the scope of this invention, of course, to control other functions of other types of machines with the control element. The pivotal grip 2 can be used to control any function related to that of a lever provided with such a grip, and similarly the thumb pin 5 can control yet another function. The particular application according to this invention is not intended to limit the applicability of it or the scope of the claims.

We claim:

1. A control element for a machine, said element comprising:

a lever pivotal about and generally perpendicular to a horizontal lever axis through angularly offset positions associated with respective operational levels of said machine;

a handle carried on said lever remote from said lever axis and centered on a handle axis substantially parallel to and offset from said lever axis;

a grip carried on said handle and rotatable thereon about said handle axis between at least one grip end position and an angularly offset grip central position;

means including a grip switch actuatable by said grip only in said grip end position;

a thumb-operable pin axially displaceable in said handle between an outer pin position and at least one inner pin position;

means including a pin switch actuatable by said pin only to said inner pin position said lever having an outer end provided with a cylindrical tube centered on said handle axis, said pin being axially displaceable inside said tube and said grip being angularly displaceable on said tube;

biasing means for urging said pin into said outer pin position; and means for retaining said grip releasably in said central position, said grip being formed with a radially outwardly open notch, said means for retaining including a spring-loaded member radially inwardly engageable in said notch.

2. The control element defined in claim 1 wherein said grip is formed with at least one radially outwardly open and angularly extending groove having a region of relatively shallow depth aligned radially with said grip switch in said grip end position and a region of relatively deep depth aligned radially with said grip switch in said grip central position, said grip switch having a switch member spring biased into engagement with said groove.

3. The control element defined in claim 2 wherein said grip has two such end positions to either angular side of said grip central position, each such grip end position being associated with a respective such grip switch, said grip being formed with two such grooves each having one such shallow region radially aligned with the respective grip switch in the respective end position.

4. A control element for a machine, said element comprising:

a lever pivotal about a lever axis through angularly offset positions associated with respective operational levels of said machine;

a handle carried on said lever remote from said lever axis and centered on a handle axis different from said lever axis;

a grip carried on said handle and rotatable thereon about said handle axis between at least one grip end position and an angularly offset grip central position;

means including a grip switch actuatable by said grip only in said grip end position;

a thumb-operable pin axially displaceable in said handle between an outer pin position and at least one inner pin position;

means including a pin switch actuatable by said pin only in said inner pin position; and biasing means for urging said pin into said outer pin position, said pin switch having a switch member spring biased into engagement with said pin, said pin being formed with a control surface aligned with said pin switch in said outer position and offset from said pin switch in said inner position, said control surface being formed by a radially outwardly open cutout and said switch member is radially spring biased.

5. The control element defined in claim 4 wherein said grip is formed with at least one radially outwardly open and angularly extending groove having a region of relatively shallow depth aligned radially with said grip switch in said grip end position and a region of relatively deep depth aligned radially with said grip switch in said grip central position, said grip switch having a switch member spring biased into engagement with said groove and displaceable parallel to said switch member of said pin switch.

6. A control element for a machine, said element comprising:

a lever pivotal about a lever axis through angularly offset positions associated with respective operational levels of said machine;

a handle carried on said lever remote from said lever axis and centered on a handle axis different from said lever axis;

a grip carried on said handle and rotatable thereon about said handle axis between at least one grip end position and an angularly offset grip central position;

means including a grip switch actuatable by said grip only in said grip end position;

a thumb-operable pin axially displaceable in said handle between an outer pin position and at least one inner pin position;

means including a pin switch actuatable by said pin only in said inner pin position; and biasing means for urging said pin into said outer pin position, said pin switch having a switch member radially spring biased into engagement with said pin, said pin being formed with a control surface aligned with said pin switch in said outer position and offset from said pin switch in said inner position.

* * * * *